US011276936B1

(12) United States Patent
Cripe

(10) Patent No.: US 11,276,936 B1
(45) Date of Patent: Mar. 15, 2022

(54) EFFICIENT FREQUENCY AGILE TACTICAL HF ANTENNA

(71) Applicant: Rockwell Collins, Inc., Cedar Rapids, IA (US)

(72) Inventor: David W. Cripe, Mount Vernon, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 344 days.

(21) Appl. No.: 16/596,571

(22) Filed: Oct. 8, 2019

(51) Int. Cl.
*H01Q 11/06* (2006.01)

(52) U.S. Cl.
CPC ..... *H01Q 11/06* (2013.01)

(58) Field of Classification Search
CPC ..... H01Q 11/06
USPC ..... 343/733
See application file for complete search history.

(56) References Cited

U.S. PATENT DOCUMENTS

| | | | | |
|---|---|---|---|---|
| 1,034,586 | A | 8/1912 | Corrao | |
| 3,725,936 | A | 4/1973 | Sherman | |
| 4,511,898 | A | 4/1985 | Bush | |
| 4,536,768 | A | 8/1985 | Dubowicz | |
| 7,463,211 | B2 * | 12/2008 | Mertel | H01Q 3/12 343/810 |
| 9,667,277 | B2 | 5/2017 | Moon et al. | |
| 2015/0024696 | A1 * | 1/2015 | Jin | H04B 1/18 455/77 |

* cited by examiner

*Primary Examiner* — Andrea Lindgren Baltzell
(74) *Attorney, Agent, or Firm* — Suiter Swantz pc llo

(57) ABSTRACT

A half-rhombic antenna includes an addressable switch at the apex. The addressable switch is opened or closed base on the operating frequency of the antenna. The addressable switch is open when operating at odd multiples of the lowest frequency and closed when operating at even multiples of the lowest frequency. The feedpoint includes a tuning element to adjust impedance within a range defined by the operating range of the switched antenna.

15 Claims, 3 Drawing Sheets

EFFICIENT FREQUENCY AGILE TACTICAL HF ANTENNA

BACKGROUND

Communication systems that operate in the high-frequency (HF) spectrum of 2 to 30 MHz utilize ionospheric propagation for reliable, beyond-line-of-sight communication over distances of multiple hundreds or thousands of miles. Military HF gear must be frequency agile and able to operate anywhere in the HF range because the maximum or minimum useable frequencies are unpredictable for any given situation.

While the transmitting and receiving equipment is easily capable of covering this range, antennas capable of covering a decade-and-a-half span of frequencies offer significant challenges. Typical broadband solutions such as log-periodic beams, rhombic antennas, or discone antennas are large, complex structures best suited for permanent, fixed-site installations.

For tactical HF applications, portability is a primary consideration. Such portable antennas are typically wire antennas employing telescoping masts or improvised attachment points to elevate the antenna above ground. Wire antennas are typically relatively narrow band and must be dimensioned to provide resonance and a good voltage standing wave ratio (VSWR) at 2 MHz, but the feedpoint impedance at other frequencies in the range up to 30 MHz must also present benign VSWR. At odd harmonics of 2 MHz antennas exhibit a harmonic resonance and benign VSWR, but at even harmonics, antennas are anti-resonant and the VSWR is extremely high.

Existing solutions, such as terminated, folded dipoles, are dimensioned for the lowest operational frequency (at least 60 meters end-to-end). A power resistor load (commonly 400 to 600 ohms) is incorporated at the apex of the fold, opposite the feedpoint. The resistor tends to diminish the high impedance extremes encountered at anti-resonance, but also results in a 20 dB or higher loss in radiated power compared to resonant frequencies. These systems require at least two people to carry and erect.

SUMMARY

In one aspect, embodiments of the inventive concepts disclosed herein are directed to a half-rhombic antenna with an addressable switch at the apex. The addressable switch is opened or closed base on the operating frequency. The addressable switch is open when operating at odd multiples of the lowest frequency and closed when operating at even multiples of the lowest frequency.

In a further aspect, the feedpoint includes a tuning element to adjust impedance within a range defined by the operating range of the switched antenna.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
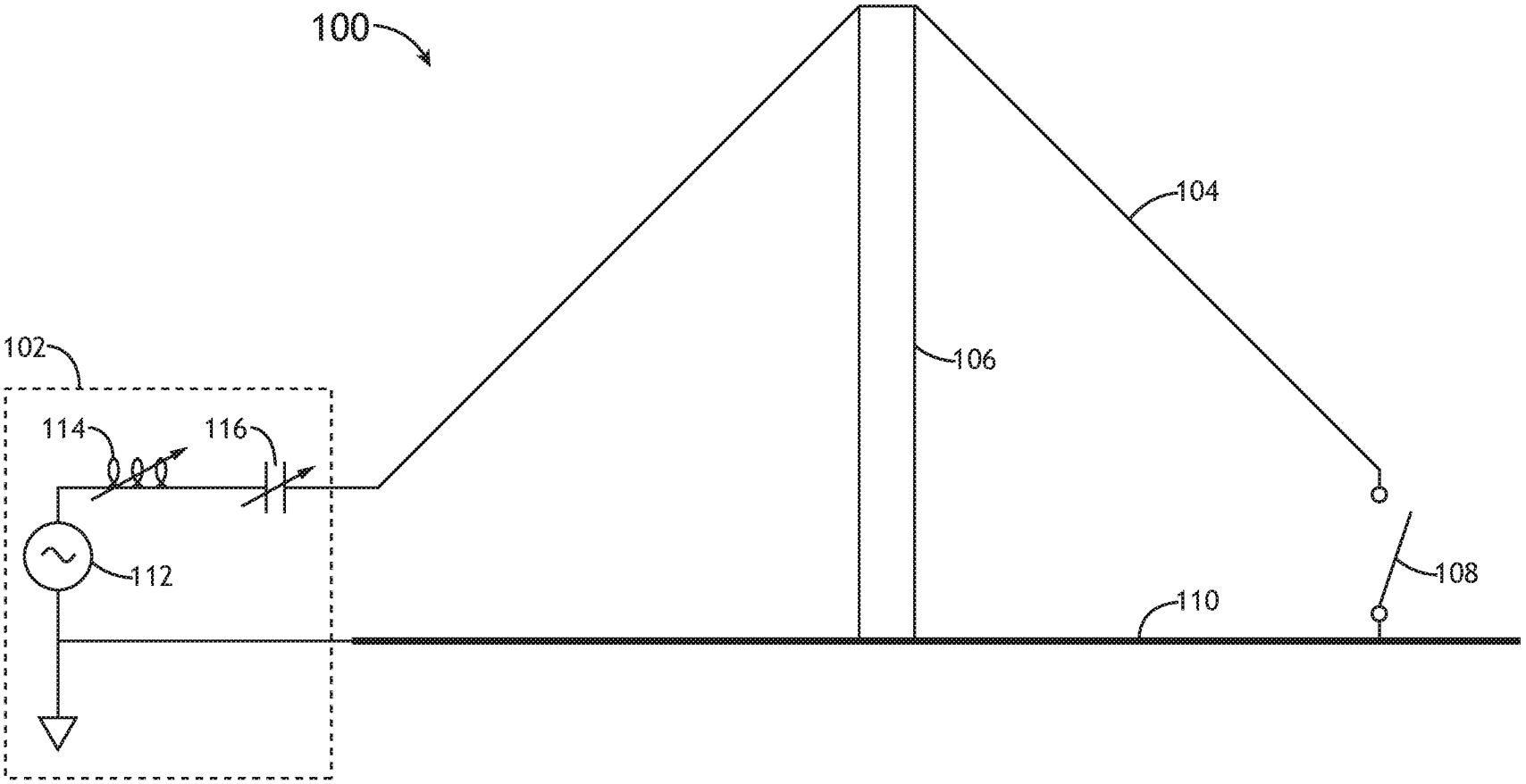
FIG. 1 shows a diagrammatic view of an exemplary embodiment of an antenna according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a half-rhombic antenna with an addressable switch at the apex. The addressable switch is opened or closed base on the operating frequency. The addressable switch is open when operating at odd multiples of the lowest frequency and closed when operating at even multiples of the lowest frequency.

Referring to FIG. 1, a diagrammatic view of an exemplary embodiment of an antenna 100 according to the inventive concepts disclosed herein is shown. The antenna 100 comprises a feedpoint element 102, a half-rhombic antenna wire 104 supported by a mast 106, and an addressable switch 108 located at the apex of the half-rhombic antenna wire 104, just above the earth/ground plane 110.

In at least one embodiment, during actual deployment, the wire 104 is coupled to ground plane 110 at two points some multiple of the minimum operating wavelength of the antenna 100 apart (for example, approximately one-quarter the wavelength at 2 MHz). The ground return at the two ends of the wire 104 may simply rest on the ground plane 110, or ground radials may be employed at both ends to further improve ground coupling. The center of the wire 104 is raised via the mast 106 to some multiple of the minimum operating wavelength of the antenna 100 (for example, approximately one-sixteenth the wavelength at 2 MHz). The mast 106 may be collapsible for east transport and deployment by a single person.

In at least one embodiment, the feedpoint element 102 includes a signal source 112 such as a transceiver that provides a transmission signal to the wire 104 via an adjustable inductor 114 and adjustable capacitor 116, tunable for specific frequencies. The signal source 112 is grounded, along with one pole of the addressable switch 108. Either the feedpoint element 102 or some other control mechanism (such as a separate processor) opens and closes the addressable switch 108 based on a current operating frequency of the feedpoint element 102 as follows:

| Frequency | Switch |
|---|---|
| 2-3 MHz | Open |
| 3-5 MHz | Closed |
| 5-7 MHz | Open |
| 7-9 MHz | Closed |
| 9-11 MHz | Open |
| 11-13 MHz | Closed |
| 13-15 MHz | Open |
| 15-17 MHz | Closed |
| 17-19 MHz | Open |
| 19-21 MHz | Closed |
| 21-23 MHz | Open |
| 23-25 MHz | Closed |
| 25-27 MHz | Open |
| 27-29 MHz | Closed |
| 29-30 MHz | Open |

It may be appreciated that the pattern of having the addressable switch 108 "open" for odd multiples of the lowest operating frequency and "closed" for even multiples of the lowest operating frequency are exemplary in nature and could be defined differently. Furthermore, the range of operating frequencies could be extendable to other frequency ranges. The state of the addressable switch 108 alters the feedpoint impedance and VSWR as more fully described herein.

Figure 2:
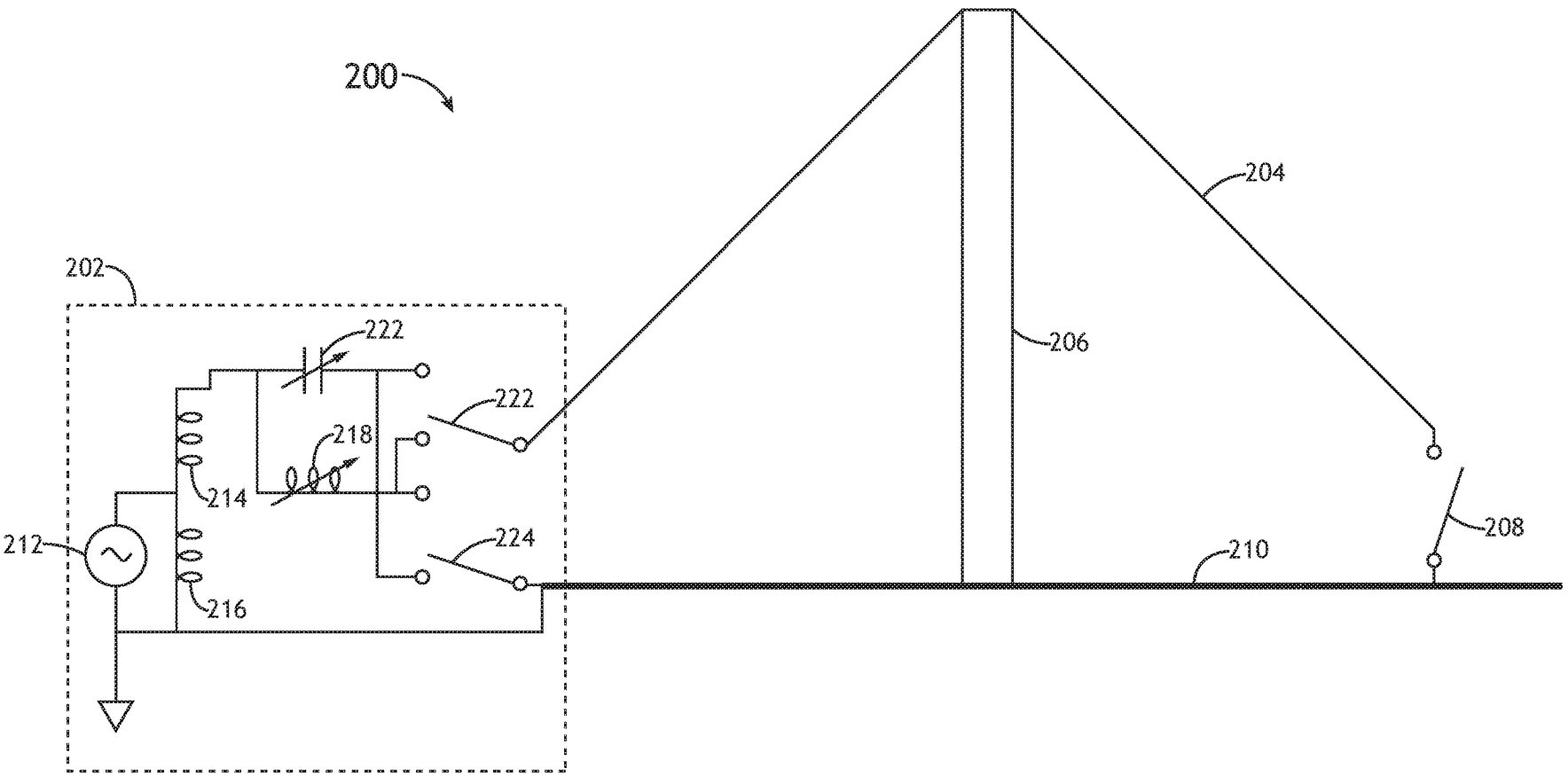
FIG. 2 shows a diagrammatic view of an exemplary embodiment of an antenna according to the inventive concepts disclosed herein.

Referring to FIG. 2, a diagrammatic view of an exemplary embodiment of an antenna 200 according to the inventive concepts disclosed herein is shown. The antenna 200 comprises a feedpoint element 202, a half-rhombic antenna wire 204 supported by a mast 206, and an addressable switch 208 located at the apex of the half-rhombic antenna wire 204. Either the feedpoint element 202 or some other control mechanism (such as a separate processor) opens and closes the addressable switch 208 based on a current operating frequency of the feedpoint element 202 such that the addressable switch 208 is "open" for odd multiples of the lowest operating frequency and "closed" for even multiples of the lowest operating frequency.

In at least one embodiment, the feedpoint element 202 is configured as an "L" network, including a signal source 212 such as a transceiver that provides a transmission signal to the wire 204. A series of inductors 214 connect the source 212 to an adjustable capacitor 220 and ground respectively. A set of feedpoint switches 222, 224, comprising a DPDT switch, are configured to, in a first orientation, connect the wire 204 to the source 212 via a third adjustable inductor 218 and one pole of the addressable switch 208 to the capacitor, and in a second orientation, connect the wire 204 to the source 212 via the adjustable capacitor 220 and the pole of the addressable switch 208 *t* the third adjustable inductor 218. Such an embodiment provides a feedpoint impedance up to 112 ohms. The DPDT switch 222, 224 exchanges the position of the adjustable inductor 218 and adjustable capacitor 220 to compensate for feedpoint impedance being either inductive or capacitive. A 9:4 unbalanced-to-unbalanced (U NUN) transformer may transform the 112 ohms to 50 ohms.

Figure 3:
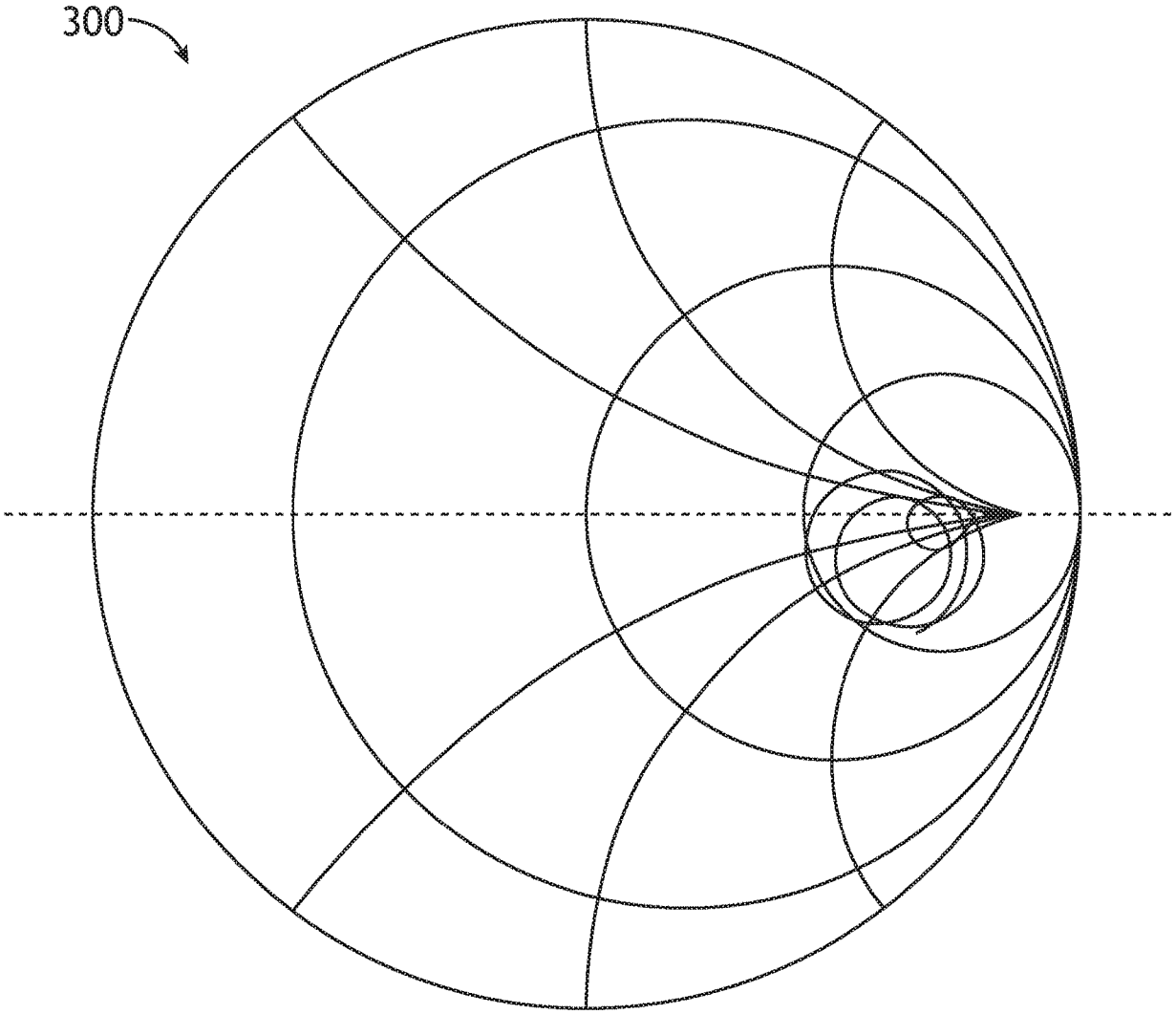
FIG. 3 shows a Smith chart illustrating certain features of the inventive concepts disclosed herein.

Referring to FIG. 3, a Smith chart 300 illustrating certain features of the inventive concepts disclosed herein is shown. The inclusion of the addressable switch effectively restricts the performance profile of the antenna to one half of the Smith chart 300 by closing the addressable switch as system approaches the 180 degree mark.

When the switch is open, for odd harmonics of 2 MHz, the impedance of the feedpoint has a real term that lies between nominally 33 and 80 ohms, so that if the reactive component were eliminated by the variable reactance, the resultant VSWR lies below 1.5:1, for a 50-ohm system. For even harmonics of 2 MHz, the wire performs an impedance inversion, so the switch is closed. Again, the VSWR of the feedpoint has a real term that lies inside 1.5:1 fora 50-ohm system.

Antennas according to the present disclosure provide relatively benign VSWR and good efficiency and gain at even harmonics of lowest frequency of operation.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. An antenna comprising:

a feedpoint element;

a wire element connected to the feedpoint element;

a mast configured to elevate the wire element to form a half-rhombic antenna structure; and an addressable switch connected to the wire element, disposed at an apex of the half-rhombic antenna structure, wherein:

the addressable switch is connected to the feedpoint element; and the feedpoint element is configured to open or close the addressable switch based on an operating frequency of the antenna with respect to a lowest frequency of the antenna.

2. The antenna of claim 1, wherein the feedpoint element is configured to open the addressable switch at odd harmonics of the lowest frequency and close the addressable switch at even harmonics of the lowest frequency.

3. The antenna of claim 1, wherein the operating frequency is within a range of 2 MHz to 30 MHz, and the lowest frequency is 2 MHz.

4. The antenna of claim 1, wherein the feedpoint element comprises an adjustable inductor and an adjustable capacitor in series configured to tune an impedance between a signal source and the wire element within a range between 30 ohms to 80 ohms.

5. The antenna of claim 4, wherein the antenna produces a VSWR below 1.5:1.

6. The antenna of claim 1, wherein the feedpoint element comprises:

an adjustable inductor and an adjustable capacitor in parallel configured to tune an impedance between a signal source and the wire element within a range below 112 ohms; and a DPDT switch.

7. The antenna of claim 1, further comprising a 9:4 UNUN transformer.

8. A communication system comprising:

an antenna comprising:

a feedpoint element;

a wire element connected to the feedpoint element;

a mast configured to elevate the wire element to form a half-rhombic antenna structure; and an addressable switch connected to the wire element, disposed at an apex of the half-rhombic antenna structure, wherein:

the addressable switch is connected to the feedpoint element; and the feedpoint element is configured to open or close the addressable switch based on an operating frequency of the antenna with respect to a lowest frequency of the antenna.

9. The communication system of claim 8, wherein the feedpoint element is configured to open the addressable switch at odd harmonics of the lowest frequency and close the addressable switch at even harmonics of the lowest frequency.

10. The communication system of claim 8, further comprising a process configured to open the addressable switch at odd harmonics of the lowest frequency and close the addressable switch at even harmonics of the lowest frequency.

11. The communication system of claim 8, wherein the operating frequency is within a range of 2 MHz to 30 MHz, and the lowest frequency is 2 MHz.

12. The communication system of claim 8, wherein the feedpoint element comprises an adjustable inductor and an adjustable capacitor in series configured to tune an impedance between a signal source and the wire element within a range between 30 ohms to 80 ohms.

13. The communication system of claim 12, wherein The communication system produces a VSWR below 1.5:1.

14. The communication system of claim 8, wherein the feedpoint element comprises:

an adjustable inductor and an adjustable capacitor in parallel configured to tune an impedance between a signal source and the wire element within a range below 112 ohms; and a DPDT switch.

15. The communication system of claim 8, further comprising a 9:4 UNUN transformer.

* * * * *